United States Patent [19]

Okami

[11] 4,065,540

[45] Dec. 27, 1977

[54] METHOD OF PRODUCING PRECAST CONCRETE PANELS WITH BUILT-IN OUTER SASH FRAMES

[75] Inventor: Eiryo Okami, Kurobe, Japan

[73] Assignee: Yoshida Kogyo K.K., Tokyo, Japan

[21] Appl. No.: 623,558

[22] Filed: Oct. 17, 1975

[30] Foreign Application Priority Data

Oct. 19, 1974 Japan ..... 49-120636

[51] Int. Cl.[2] ..... B28B 1/14

[52] U.S. Cl. ..... 264/278; 249/39; 249/93; 264/274

[58] Field of Search ..... 264/274, 278; 249/83, 249/93, 95, 39; 52/208

[56] References Cited

U.S. PATENT DOCUMENTS

| | | | |
|---|---|---|---|
| 1,881,971 | 10/1932 | Roedig | 249/95 X |
| 2,602,983 | 7/1952 | Troiel | 249/95 |
| 2,901,810 | 9/1959 | Richards | 249/95 X |
| 3,994,470 | 11/1976 | Nakada | 249/39 X |

*Primary Examiner*—Thomas P. Pavelko

*Attorney, Agent, or Firm*—Hill, Gross, Simpson, Van Santen, Steadman, Chiara & Simpson

[57] ABSTRACT

A form into which concrete is to be poured has rectangular rests on its bottom for placing thereon the outer frame of a sash window or the like. The outer sash frame is secured to the rests by means of several spaced-apart fixtures arranged on the inside of the rests. Concrete is then poured into the form, and upon its solidification, the precast concrete panel is withdrawn from the form with the built-in outer sash frame. Each fixture comprises upper and lower holders that can be actuated manually into and out of engagement with the upper and lower flanges, respectively, of the outer sash frame on the rests.

1 Claim, 5 Drawing Figures

METHOD OF PRODUCING PRECAST CONCRETE PANELS WITH BUILT-IN OUTER SASH FRAMES

BACKGROUND OF THE INVENTION

1. Field of Invention

This invention relates to a method of producing precast concrete panels with built-in outer frames of sash windows or the like.

2. Prior Art

In the factory precasting of concrete wall panels integral with the outer frames of sash windows or the like, the usual practice has been to install the outer sash frame on the bottom of a form into which concrete is to be cast and to place a holder frame over the outer sash frame. The outer sash frame is then secured in position as by bolting. This conventional practice has a disadvantage in connection with a highly involved procedure required for the installation of the outer sash frame and for the assembly and disassembly of the form.

It has also been the practice heretofore to secure the entire outer sash frame, or at least the corners thereof, to the form. This practice is objectionable because the outer sash frame is restrained from elongation or expansion in the steam curing of the concrete cast in the form. The outer sash frame that has been built into the concrete panel in this manner tends to buckle out in its mid-portions. When the sashes are installed in the outer frame, therefore, unnecessary gaps may exist between the sashes and outer frame, or the sashes may not be smoothly movable between their closed and open positions.

SUMMARY OF THE INVENTION

It is an object of this invention to provide an improved method of producing precast concrete panels with built-in outer frames of sash windows or the like, whereby the listed disadvantages of the prior art are overcome in a simple and thoroughly practicable manner.

Another object of the invention is to provide a method of the character described whereby an outer sash frame can be positively and readily secured in position within a form, and the completed concrete panel with the built-in outer sash frame can be easily withdrawn from the form.

Still another object of the invention is to provide a method of the above described character wherein the outer sash frame is secured to the form so as to permit elongation or expansion during steam curing of the concrete, so that the outer sash frame can be built into the concrete panel without undesirable deformation.

According to the method of this invention, briefly summarized, there is first provided a form which is constituted of a bottom, rectangular side panels on the bottom, and rectangular rest means arranged inside of the side panels on the bottom. Arranged further inside of the rest means are a plurality of spaced-apart fixtures each including lower and upper holders for holding lower and upper flanges of a rectangular outer sash frame to be built into a concrete panel. The outer sash frame is placed upon the rest means and is secured thereto by the fixtures, all acting downwardly on the outer sash frame. Concrete is then poured into the form, and after curing of the concrete, and release of the fixtures, the precast concrete panel with the built-in outer sash frame is withdrawn from the form.

To permit elongation or expansion of the outer sash frame in the steam curing of the concrete, the fixtures should be arranged at other than the corners of the outer sash frame placed upon the rest means.

The above and other objects, features and advantages of the invention will become more apparent and understandable as the description proceeds, with reference had to the accompanying drawings in which like reference characters refer to like parts throughout.

DESCRIPTION OF THE PREFERRED METHOD EMBODIMENT

Figure 1:
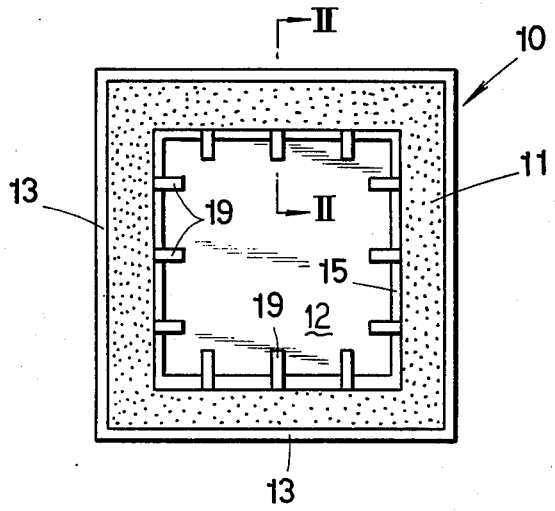
FIG. 1 is a schematic top plan view of the arrangement for production of a precast concrete panel with a built-in outer sash frame according to this invention.
Figure 2:
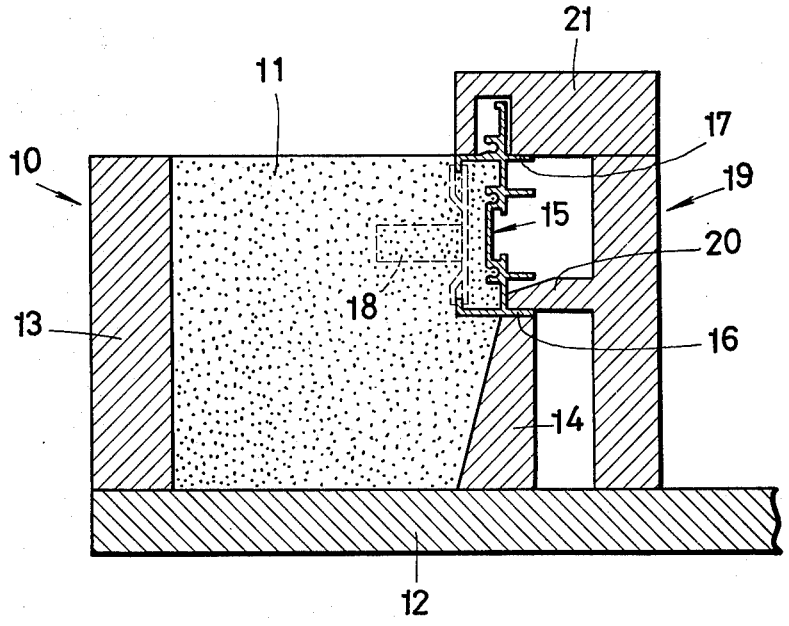
FIG. 2 is an enlarged, schematic vertical cross-sectional view taken along line II—II in FIG. 1, the view being explanatory of the method of the invention.

Reference is directed to FIGS. 1 and 2 to describe in detail the method of this invention. The numeral 10 in the drawings generally denotes a form into which concrete is to be cast in the shape of a desired panel, the cast concrete being designated 11. The form 10 comprises a horizontal platform or bottom 12 and four side panels 13 arranged rectangularly on the bottom to constitute the outer walls of the form. Also included in the form 10 are rests 14 of rectangular arrangement that are mounted on the bottom 12 internally of the side panels 13 to constitute the inner walls of the form.

The outer frame 15 of sash window or the like is placed upon the rests 14. As is well known, the outer sash frame 15 comprises a header, a sill and a pair of side jambs which are combined into generally rectangular configuration. Such constituent members of the outer sash frame 15 are each equipped with lower and upper flanges 16 and 17 or with essentially equivalent parts. If desired, suitable anchors 18 can be affixed to the outer sash frame 15.

The outer sash frame 15 is then secured to the rests 14 by means of a plurality of spaced-apart fixtures 19 that are arranged internally of the rests at other than the corners of the outer sash frame. Each fixture 19 comprises a lower holder 20 for engaging with a downward force the lower flange 16 of the outer sash frame 15 and an upper holder 21 for engaging with a downward force its upper flange 17. Both lower and upper holders 20 and 21 are retractable out of engagement with the respective flanges 16 and 17 of the outer sash frame 15.

With the outer sash frame 15 thus retained in position on the rests 14, concrete 11 may now be poured into the form 10, that is, into the space bounded by the bottom 12, side panels 13, rests 14, and outer sash frame 15. Upon curing of the concrete 11, the precast concrete panel with the built-in outer sash frame 15 is released from the form 10 by moving the lower and upper holders 20 and 21 of the fixtures 19 out of engagement with the flanges 16 and 17 of the outer sash frame.

Figure 3:
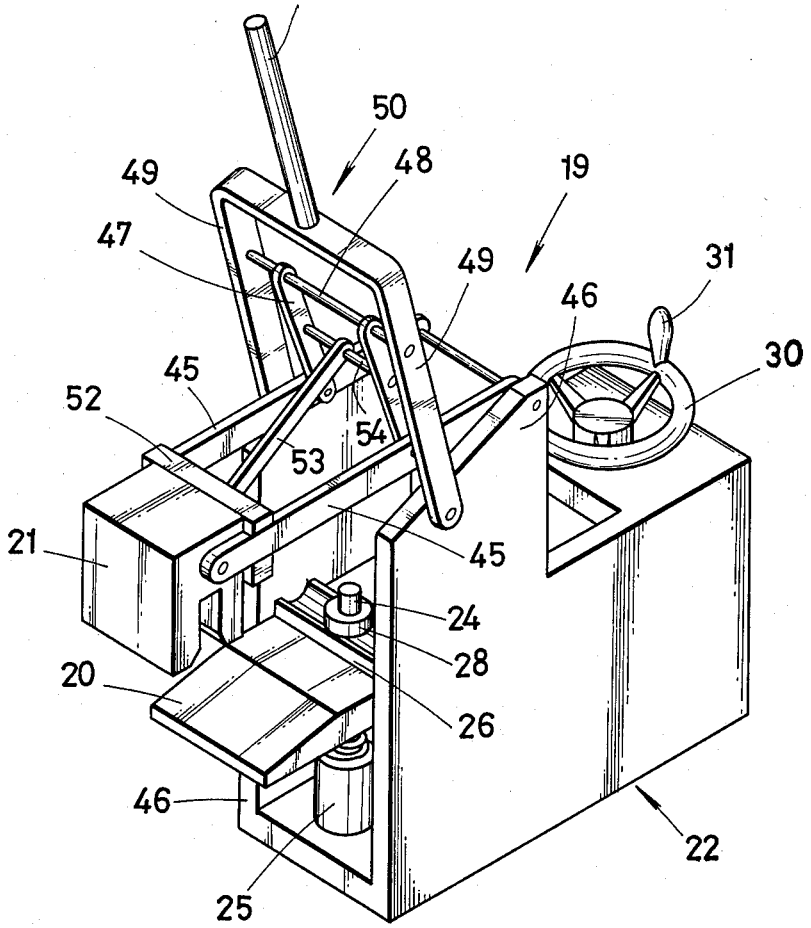
FIG. 3 is a perspective view of one of the fixtures for use in the arrangement of FIG. 1.
Figure 4:
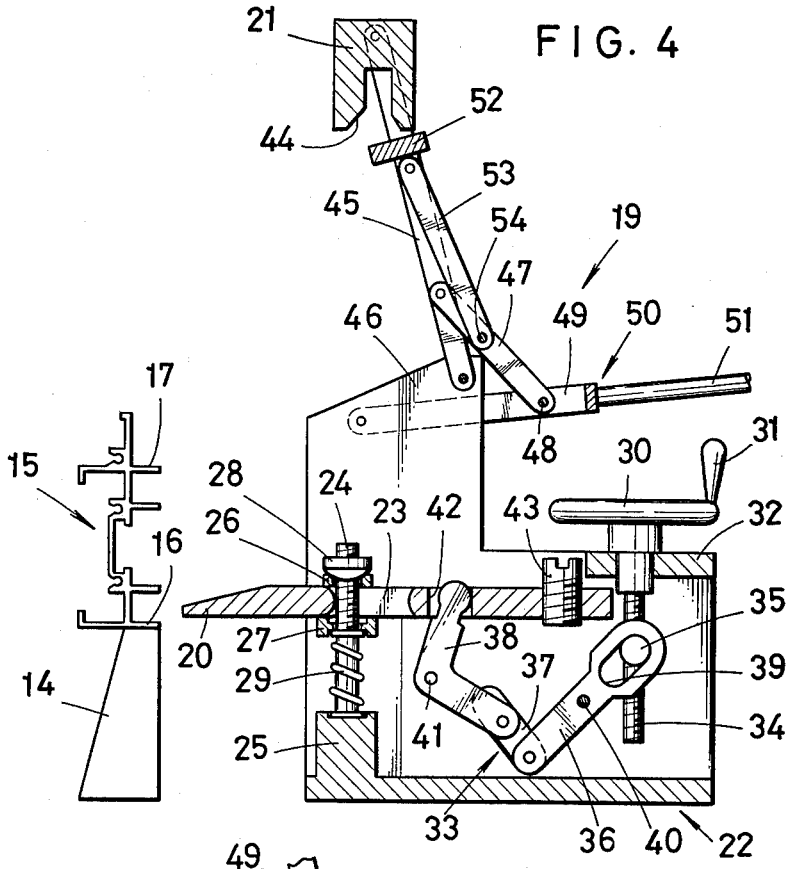
FIG. 4 is a vertical cross-sectional view showing the fixture of FIG. 3 disengaged from the outer sash frame to be built into a concrete panel in the arrangement of FIG. 1.
Figure 5:
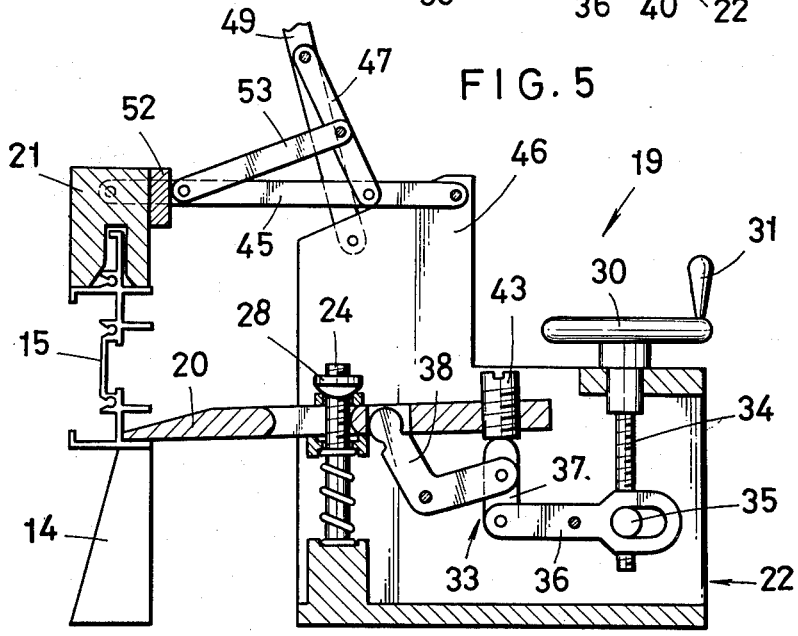
FIG. 5 is a view similar to FIG. 4 but showing the fixture in engagement with the outer sash frame.

FIGS. 3, 4 and 5 illustrate in detail the practical form of each fixture 19 for use in the above described method of precasting a concrete panel with a built-in outer sash frame according to this invention. The illustrated fixture 19 includes a support structure 22 which is adapted to be fixedly mounted on the bottom 12 of the form 10 and which supports the lower and upper holders 20 and 21 in the manner hereinafter described.

The lower holder 20 is a substantially rectangular plate supported horizontally by the support structure 22 for horizontal sliding movement toward and away from the outer sash frame 15 placed upon the rests 14 of the form 10. The lower holder 20 has a slot 23 formed substantially centrally therethrough and extending in its longitudinal direction. Extending with clearance through the slot 23, is a threaded column 24 which is fixedly mounted in upright position on a pedestal 25 formed on the bottom of the support structure 22.

A pair of upper and lower support members 26 and 27 are loosely fitted over the threaded column 24 so as to overlie and underlie the lower holder 20, respectively. Over the upper support member 26, a nut 28 having a convex bottom face is fitted onto the threaded column 24 to serve as a limit stop for the upper support member. Under the lower support member 27, a coiled compression spring 29 surrounds the column to yieldably urge the lower support member upwardly against the lower holder 20. The lower holder is thus supported between the upper and lower support members 26 and 27 so as to be pivotable through a slight angle in the vertical direction.

A hand wheel 30 complete with a grip 31 is rotatably supported over a top plate 32 at the rear of the support structure 22 for manually actuating the lower holder 20 into and out of engagement with the lower flange 16 of the outer sash frame 15 via a linkage system generally designated 33 in FIGS. 4 and 5. A threaded rod 34 extends downwardly from the hand wheel 30 for simultaneous rotation therewith, and a pin 35 is threadedly fitted over the rod 34 for up-and-down movement along the same with the rotation of the hand wheel 30.

The aforesaid linkage system 33 comprises a pair of links 36 and 37 and a bell crank 38. The link 36 has a slot 39 at one end for loosely engaging the pin 35 on the threaded rod 34 and is pivotally supported at its intermediate point 40 for pivotal movement about the same with the up-and-down movement of the pin. The other end of the link 36 is pivotally coupled to one end of the intermediate link 37, which in turn is pivotally coupled at a point adjacent its other end to one end of the bell crank 38. This bell crank is pivotally supported at 41 and has its other end somewhat loosely engaged in an aperture 42 formed in the lower holder 20.

A machine screw 43 of headless slotted type is screwed into the rear end of the lower holder 20 from above so as to partly project downwardly therefrom. The projecting end of this machine screw is constructed to make abutting contact with the said other end of the intermediate link 37 upon descent of the pin 35.

Thus, when the hand wheel 30 is manually turned in a predetermined direction to cause the descent of the pin 35 along the threaded rod 34 as shown in FIG. 5, the slotted link 36 will be caused to swing clockwise, as seen in the drawing, about its pivot 40. This clockwise swing of the slotted link 36 is transmitted via the intermediate link 37 to the bell crank 38, whereupon the bell crank will swing counterclockwise about its pivot 41. As a consequence, the lower holder 20 slides forwardly onto the lower flange 16 of the outer sash frame 15 that has been placed upon the rests 14.

The clockwise swing of the slotted link 36 causes also an upward displacement of the intermediate link 37 into abutting contact with the screw 43. The holder 20 is therefore swung counterclockwise to press the lower flange 16 against the rest 14. The degree of this counterclockwise swing of the lower holder 20 is controllable by the setting of the screw 43.

For removal of the completed concrete panel that has been precast integral with the outer sash frame 15, the hand wheel 30 is turned in the opposite direction to cause the ascent of the pin 35 along the threaded rod 34. The lower holder 20 will then retract away from the outer sash frame 15, back to the initial position of FIG. 4.

With reference again to FIGS. 3 and 4, the upper holder 21 for engaging the upper flange 17 of the outer sash frame 15 is shown to be in the form of a substantially rectangular block which is grooved at 44. This upper holder is pivotally supported on the free ends of a pair of parallel spaced levers 45 so that its grooved face may always be directed downwardly under its own weight. The levers 45 are pivotally coupled at the other ends to the respective side plates 46 of the support structure 22.

The aforesaid levers 45 in combination with a pair of levers 47 constitute a toggle mechanism which functions in the manner later described. Each of the levers 47 is pivotally coupled at one end to an intermediate point of one of the levers 45 and at the other end to a rod 48 extending between a pair of prongs 49 of an actuator lever 50.

The actuator lever 50 comprises a handle or shank 51 and the pair of prongs 49, the latter being pivotally coupled to the respective side plates 46 of the support structure 22. This actuator lever is to be swung manually to cause the up-and-down movement of the upper holder 21 into and out of engagement with the upper flange 17 of the outer sash frame 15 via the toggle mechanism.

A pusher 52 is slidably mounted on the levers 45 of the toggle mechanism for movement toward and away from the upper holder 21. The pusher is pivotally coupled to one end of a link 53, the other end of which is pivotally coupled to a rod 54 extending between the levers 47.

In the use of the fixture 19 of the above described construction, the hand wheel 30 may first be turned in the predetermined direction as aforesaid to actuate the lower holder 20 to its working position over the lower flange 16 of the outer sash frame 15 that has been placed upon the rests 14. The actuator lever 50 may then be manually turned counterclockwise, as viewed in FIGS. 4 and 5, to force the upper holder 21 down into engagement with the upper flange 17 of the outer sash frame via the toggle mechanism comprising the levers 45 and 47. Upon counterclockwise swing of the actuator lever 50, the link 53 causes the pusher 52 to slide forwardly along the levers 45 into tight contact with the upper holder 21 to establish the correct attitude of the latter over the outer sash frame 15.

As previously set forth in connection with the method of the invention, concrete 11 is then cast in the form space bounded by its bottom 12, side panels 13, rests 14, and outer sash frame 15. Upon solidification of the concrete 11 and hand wheel 30 and actuator lever 50 of each fixture 19 may be operated to cause retraction of its lower and upper holders 20 and 21 out of engagement with the outer frame 15. If necessary, the side panels 13 of the form 10 may further be removed, and the precast concrete panel with the built-in outer sash frame 15 can now be withdrawn from the form.

While the invention has been shown and described herein before in highly specific aspects thereof, it is not desired to limit the invention to the exact details disclosed, as numerous modifications and changes will readily occur to those skilled in the art. The invention, therefore, should be construed broadly and in a manner consistent with the fair meaning or proper scope of the following claim.

What is claimed is:

1. A method of producing a precast concrete panel with a built-in outer frame of a sash window or the like, wherein the outer sash frame has lowermost and uppermost flanges, said method comprising the steps of:

a. providing a form which has a bottom, side panels on said bottom for defining the outer periphery of the concrete panel, and raised rectangular sill-defining rest means arranged internally of the side panels on the bottom for defining the inner periphery of the concrete panel;

b. arranging a plurality of clamping fixtures in spaced positions on the inside of the rest means, each fixture including lower and upper holders arranged to face the raised rest means for downwardly clamping the lowermost and uppermost flanges, respectively;

c. placing the outer sash frame with the lowermost flange to rest on the top of the rest means in spaced relation to the bottom of the form;

d. clamping the outer sash frame downwardly onto the rest means by means of the lower and upper holders acting downwardly and independently of each other on the sash frame flanges remotely from its corners;

e. pouring concrete into a space bounded by the outer sash frame and the bottom, side panels and rest means of the form;

f. curing the concrete; and g. after releasing the clamping fixtures, withdrawing the precast concrete panel with the built-in outer sash frame from the form.

* * * * *